United States Patent [19]

Deger

[11] Patent Number: 4,895,369

[45] Date of Patent: Jan. 23, 1990

[54] FLIPPER CONTROL CIRCUIT FOR PINBALL MACHINE

[75] Inventor: Kurt W. Deger, Palatine, Ill.

[73] Assignee: Data East Pinball, Inc., Melrose Park, Ill.

[21] Appl. No.: 342,318

[22] Filed: Apr. 24, 1989

[51] Int. Cl.[4] ..... A63F 7/26

[52] U.S. Cl. ..... 273/129 V; 273/121 A; 273/119 A; 200/61.11

[58] Field of Search ..... 273/119 A, 120 A, 121 A, 273/122 A, 123 A, 124 A, 125 A, 129 R, 129 S, 129 V, 127; 200/61.11, DIG. 23

[56] References Cited

U.S. PATENT DOCUMENTS

| | | | |
|---|---|---|---|
| 2,318,394 | 5/1943 | Hooker | 200/61.11 |
| 3,296,390 | 1/1967 | Salger | 200/61.11 |
| 3,404,888 | 10/1968 | Lally et al. | 273/129 V |
| 3,675,927 | 7/1972 | Gottieb et al. | 273/119 A |
| 3,826,883 | 7/1974 | Foster et al. | 200/61.11 |
| 3,901,511 | 8/1975 | Garbark | 273/129 V |
| 4,199,143 | 4/1980 | Dieckhaus | 273/129 V |
| 4,203,602 | 5/1980 | Kral | 273/129 V |
| 4,384,716 | 5/1983 | Powers | 273/121 A |
| 4,437,664 | 3/1984 | Wiczer et al. | 273/129 V |
| 4,790,536 | 12/1988 | Deger | 273/129 V |

*Primary Examiner*—T. Brown

*Attorney, Agent, or Firm*—Gerstman & Ellis, Ltd.

[57] ABSTRACT

A flipper control circuit is provided for a pinball machine having a flippper, a flipper switch for activating the flipper, means for holding the flipper in an actuated position until the flipper switch is deactivated, and a solenoid coil for controlling the movement of the flipper in response to the voltage applied to the solenoid coil. A first voltage is applied to the solenoid coil when the flipper switch is activated. A second holding voltage is applied to the solenoid coil when the flipper is in the actuated position, to hold the flipper in the actuated position until the flipper switch is deactivated. A switch electrically disconnects the first voltage from the solenoid coil when the flipper is in the actuated position.

18 Claims, 1 Drawing Sheet

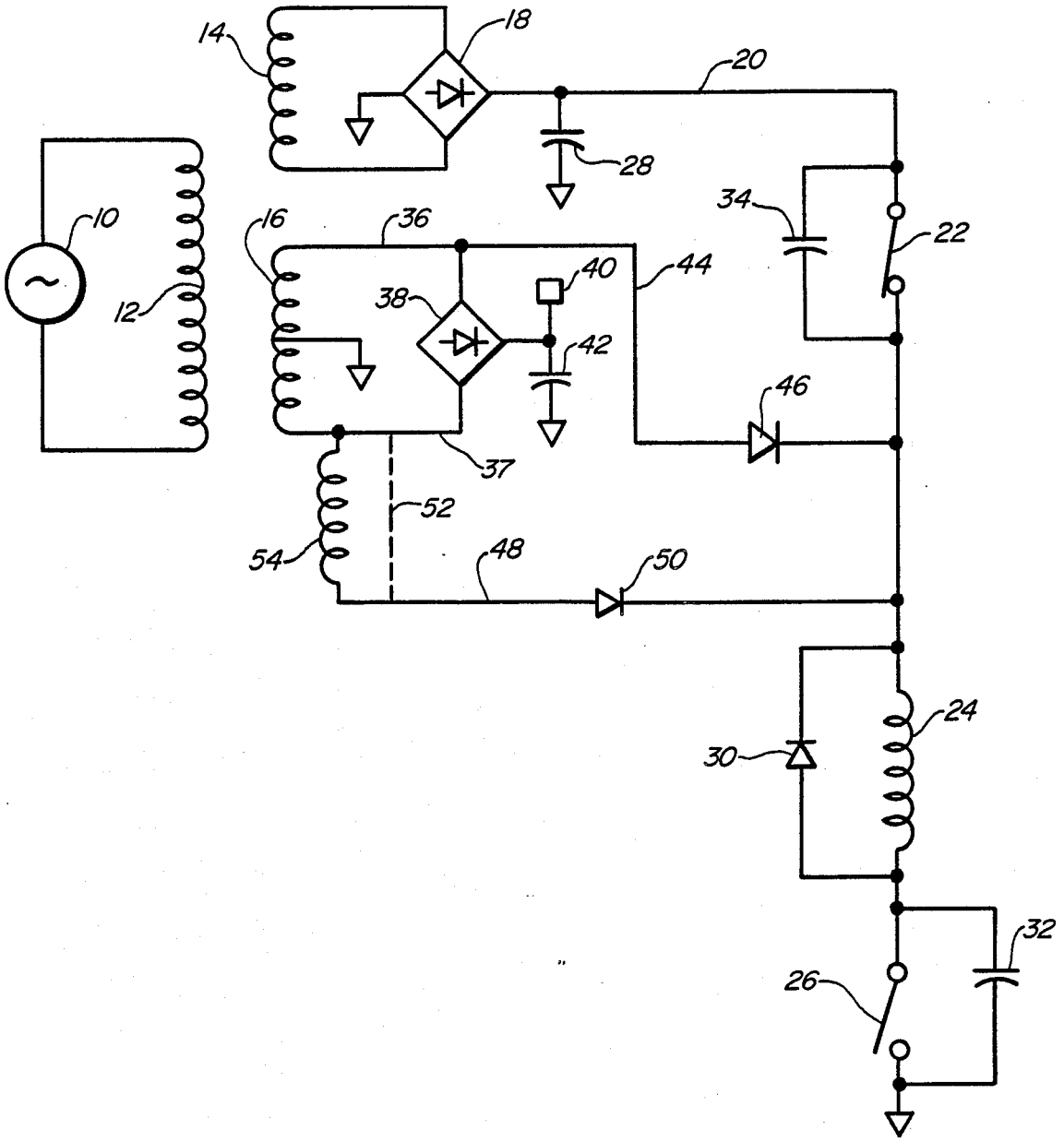
14
18
20
28
10
16
36
34
22
40
44
38
12
42
46
37
52
54
48
50
24
30
32
26

FLIPPER CONTROL CIRCUIT FOR PINBALL MACHINE

FIELD OF THE INVENTION

The present invention concerns a novel electronic control circuit for controlling the operation of pinball machine flippers.

BACKGROUND OF THE INVENTION

In pinball machines using pivotally mounted flippers, a relatively high power is required to move the flipper when the flipper switch is activated, while a much lower power is required to hold the flipper when the flipper is in the actuated position.

In one prior art pinball flipper circuit, the solenoid coil which operates the pinball flipper comprises two windings in series. One winding serves to provide a strong pull on the selenoid coil for the power stroke and a second "holding" winding serves to hold the flipper in the actuated position. This arrangement was considered necessary since a single coil winding was not considered capable of both high power and continuous operation. When the flipper is at rest, a normally closed "end of stroke" switch bypasses the holding winding, leaving only the power winding in the circuit. When the flipper is actuated, the power winding is active throughout the mechanical stroke until, at the end of travel, the flipper mechanism opens the end of stroke switch and places the low power holding winding in the circuit. This arrangement requires that the flipper switch and the end of stroke switch break a high current circuit with resulting arcing and contact wear. The high current levels required also necessitate the use of a relay to enable or disable the flipper circuits under control of the game logic.

In Powers U.S. Pat. No. 4,384,716, a flipper control circuit is disclosed in which a full wave rectified voltage is applied to the solenoid coil when a flipper switch is activated, to place the flipper in an actuated position. When the flipper has been sensed to be in the actuated position, only a partial phase control voltage is applied to the solenoid coil to hold the flipper in the actuated position until the flipper switch is deactivated.

In Deger U.S. Pat. No. 4,790,536, the solenoid for controlling the flipper includes low and high resistance coils placed in electrically parallel relationship across a source of electrical energy upon activation of the flipper switch. At the end of the travel of the flipper, the end of stroke switch automatically removes electrical energy from the low resistance coil and leaves only the high resistance coil energized to hold the flipper in position.

I have discovered a novel flipper control circuit which obviates the need for a dual coil solenoid, is simple in operation and is efficient to manufacture.

SUMMARY OF THE INVENTION

In accordance with the present invention, a pinball machine is provided having a flipper and including a flipper switch for activating the flipper and means for holding the flipper in an actuated position until the flipper switch is deactivated, and a solenoid coil for controlling the movement of the flipper in response to the voltage applied to the solenoid coil. The improvement comprises first means for applying a first voltage to the solenoid coil when the flipper switch is activated. Second means are provided for applying a second, holding voltage to the solenoid coil when the flipper is in the actuated position to hold the flipper in the actuated position until the flipper switch is deactivated. Switch means are provided for electrically disconnecting the first means from the solenoid coil when the flipper is in the actuated position.

In the illustrative embodiment, the second means include means for preventing the second means from applying the second voltage to the solenoid coil when the switch means is not electrically disconnecting the first means from the solenoid coil.

In the illustrative embodiment, the preventing means comprises a diode that is reverse bias during application of the first voltage to the solenoid coil.

In the illustrative embodiment, the first means comprises means for supplying a rectified unfiltered voltage and the second means comprises a stepped-down AC voltage source and means for blocking the alternating current from the stepped-down AC voltage source when the first voltage is being applied to the solenoid coil. The rectified AC voltage from the first means has its waveform in synchrony with the stepped-down AC voltage source.

A more detailed explanation of the invention is provided in the following description and claims, and is illustrated in the accompanying drawing.

BRIEF DESCRIPTION OF THE DRAWING

The drawing comprises a schematic circuit diagram of a flipper control circuit for a pinball machine, constructed in accordance with the principles of the present invention.

DETAILED DESCRIPTION OF THE ILLUSTRATIVE EMBODIMENT

In the illustrative embodiment, a source of household current (approximately 120 volts AC) 10 is supplied through transformer primary winding 12 to secondary windings 14 and 16. The alternating current at winding 14, which is approximately 50 volts, is rectified by full wave rectifier 18 and is fed via line 20, through a normally closed end of stroke switch 22, to a single unitary solenoid coil 24 which is connected through normally open flipper switch 26 to ground.

A capacitor 28, which as a specific example without limitation could be 100 microfarads, is connected from line 20 to ground to provide a low impedance for energy stored in the solenoid coils. Solenoid coil 24 controls a solenoid plunger which itself controls the movement of the flipper. A clamping diode 30 is connected across the solenoid coil 24 and the capacitor 32 is connected across flipper switch 26 to limit the voltage rise across flipper switch 26, when opened, by absorbing the energy stored in solenoid coil 24.

A capacitor 34 is connected across end of stroke switch 22 for storing the energy transferred when end of stroke switch 22 opens, in order to prevent end of stroke switch 22 from having to dissipate the energy which would eventually destroy the switch contacts.

Secondary coil 16 is center tapped to provide, in the illustrative embodiment, 9.7 VAC on line 36 and 9.7 VAC on line 37, which lines 36, 37 are connected to rectifier 38. Rectifier 38 provides 12 volts DC at point 40 and is connected to ground through capacitor 42.

Line 36 is connected to line 44 which includes diode 46. Line 37 is connected to line 48 which includes diode 50. Line 37 may be connected directly to line 48 via line 52 or an optional transformer secondary winding 54 may be provided.

In the operation of the circuit, the pinball machine flipper is activated by closing flipper switch 26 so that raw (unfiltered or pulsating) approximately 50 volts DC is applied to solenoid coil 24. Capacitor 28 does not provide any filtering because the capacity of capacitor 28 is small compared to the energy required to activate flipper solenoid 24 and thus capacitor 28 is essentially out of the circuit when the flipper is initially energized. Capacitor 28 provides a low impedance for energy stored in the solenoid coils but does not supply energy to the solenoid coils.

When the solenoid plunger controlled by solenoid coil 24 nears the end of its stroke, an attached mechanical lever opens the end of stroke switch 22, thereby disconnecting the 50 VDC to coil 24. With the plunger resting against a plunger stop and the 50 VDC removed, a holding current is supplied to coil 24 via diodes 50 and 46. The solenoid coil 24 requires much less current to sustain the solenoid plunger against the plunger stop than to move the plunger, and thus the voltage supplied to the solenoid coil through diodes 50 and 46 can be far less than 50 volts.

When end of stroke switch 22 opens, as stated above, energy stored in solenoid coil 24 is transferred to capacitor 34 to prevent switch 22 from having to dissipate the energy that would eventually destroy its contacts. Unlike the circuit in Deger U.S. Pat. No. 4,790,536 in which the energy absorbing capacitor must absorb all of the energy in the coil, only a fraction of that energy is transferred in the instant invention because diodes 50 and 46 are supplying current to solenoid 24. Additionally, without capacitor 34 the destructive voltage generated by opening switch 22 is less than the voltage generated by opening the end of stroke switch in U.S. Pat. No. 4,790,536 because of the continuous current supplied by diodes 50 and 46.

To release the flipper, flipper switch 26 is deactivated (opened). Diode 30 operates to clamp the voltage across solenoid coil 24 to approximately 0.7 volts and capacitor 32 limits the voltage rise across flipper switch 26 by absorbing the energy stored in solenoid coil 24.

Winding 54 is an optional winding which boosts the 9.7 VAC to a higher value for increased holding current, if desired.

Diodes 50 and 46 operate as reverse blocking diodes since they only conduct current when the anode side is at a higher potential than the cathode side. When end of stroke switch 22 is closed and 50 volts is applied to solenoid coil 24, diodes 50 and 46 are reverse biased. Therefore, current is not supplied to the coil at that time via diodes 50 and 46. However, with end of stroke switch 22 open and the 50 VDC removed, diodes 50 and 46 will supply current to solenoid coil 24.

An AC voltage source is applied to diodes 50 and 46 because the 50 VDC circuit is, for all practical purposes, unfiltered (pulsating). If a filtered DC voltage were used for the holding current, diodes 50 and 46 would be forward biased when the pulsating 50 VDC fell below the DC holding voltage. This might not be a problem in a pinball machine having only one flipper, but where there are several coils and flippers, problems would be created because when one coil or flipper is not operating, diodes 50 and 46 would supply current through switch 22 to other coils and flippers. This problem could be overcome by providing a reverse blocking diode in each 50 VDC line feeding a coil, but such a provision would not be cost effective.

It can be seen that the circuit is constructed so that the waveform on the high voltage line 20 is in synchrony with the waveform on the low voltage line 44 or the waveform on the other low voltage line 48. In this manner, while switch 22 is closed, diodes 50 and 46 will remain reverse biased.

Although an illustrative embodiment of the invention has been shown and described, it is to be understood that various modifications and substitutions may be made by those skilled in the art without departing from the novel spirit and scope of the present invention.

For example, while switch 22 is illustrated as a mechanical switch, it could be a high power semiconductor switch. Further, the switch 22, instead of being controlled by the sensing of the actual travel of the solenoid coil, could be controlled by a timing circuit which starts timing when the switch 26 is closed. The timer could open switch 22 after a predetermined time, for example 20 msec. to 60 msec.

If, for example, a transistor were used for switch 22, the transistor could be controlled by a low current, mechanical switch responsive to the end of stroke or timing circuit, and capacitor 34 would be unnecessary.

Alternatively to using diodes 50 and 46, a semiconductor switch such as a silicon controlled rectifier could be utilized. Further, a transistor could be inserted in line with diodes 50 and 46.

Alternatively, end of stroke switch 22, diode 50 and diode 46 could be replaced with switches that are externally controlled, and, in this manner, flipper switch 26 could be used to activate switch 22 and diodes 50 and 46 in a separate circuit while solenoid coil 24 is connected directly to ground.

What is claimed is:

1. In a pinball machine having a flipper and including a flipper switch for activating the flipper and means for holding the flipper in an actuated position until the flipper switch is deactivated, and a solenoid coil for controlling the movement of the flipper in response to the voltage applied to the solenoid col, the improvement comprising, in combination:

first means for applying a first voltage to the solenoid coil when the flipper switch is activated;

second means for applying a second, holding voltage to the solenoid coil when the flipper is in the actuated position to hold the flipper in the actuated position until the flipper switch is deactivated; and switch means for electrically disconnecting said first means from said solenoid coil when the flipper is in the actuated position.

2. In a pinball machine as defined by claim 1, said second means including means for preventing said second means from applying said second voltage to the solenoid coil when said switch means is not electrically disconnecting said first means from said solenoid coil.

3. In a pinball machine as defined by claim 2, said preventing means comprising a diode that is reverse biased during application of said first voltage to said solenoid coil.

4. In a pinball machine as defined by claim 1, said first means comprising means for supplying a rectified unfiltered voltage.

5. In a pinball machine as defined by claim 1, said second means comprising a stepped-down AC voltage source and means for blocking the alternating current from said stepped-down AC voltage source when the first voltage is being applied to the solenoid coil.

6. In a pinball machine as defined by claim 5, said first voltage comprising a rectified AC voltage having its wave form in synchrony with said stepped-down voltage source.

7. In a pinball machine as defined by claim 6, said blocking means comprising a diode that is reverse bias during application of said first voltage to the solenoid coil.

8. In a pinball machine as defined by claim 1, said switch means including a normally closed switch with a capacitor connected in parallel thereto to dissipate energy when said switch is open.

9. In a pinball machine as defined by claim 1, in which said solenoid includes a solenoid plunger within the solenoid coil and said switch means is operable to electrically disconnect said first means from said solenoid coil when said solenoid plunger reaches a predetermined position.

10. In a pinball machine as defined by claim 1, including timing means for operating said switch means, said timing means being actuated when the flipper switch is activated.

11. In a pinball machine as defined by claim 1, said second means including means preventing said second means from receiving current from said first means when said switch means is not electrically disconnecting said first means from said second means.

12. In a pinball machine as defined by claim 11, said preventing means comprising a diode that is reverse bias during application of said first voltage to the solenoid coil.

13. In a pinball machine as defined by claim 11, said first means comprising means for supplying a rectified unfiltered voltage.

14. In a pinball machine as defined by claim 11, said switch means including a normally closed switch with a capacitor connected in parallel thereto to dissipate energy when said switch is open.

15. In a pinball machine as defined by claim 11, in which said solenoid includes a solenoid plunger within the solenoid coil and said switch means is operable to electrically disconnect said first means from said solenoid coil when said solenoid coil reaches a predetermined position.

16. In a pinball machine as defined by claim 11, including timing means for operating said switch means, said timing means being activated when the flipper switch is activated.

17. In a pinball machine having a flipper and including a flipper switch for activating the flipper and means for holding the flipper in an actuated position until the flipper switch is deactivated, a solenoid coil for controlling the movement of the flipper in response to the voltage applied to the solenoid coil, the improvement comprising, in combination:

first means for applying a rectified unfiltered voltage to the solenoid coil when the flipper switch is activated;

second means for applying a second, holding voltage to the solenoid coil when the flipper is in the actuated position to hold the flipper in the actuated position until the flipper switch is deactivated, said second means comprising a stepped-down AC voltage source and means for blocking the alternating current from the AC voltage source when the first voltage is being applied to the solenoid coil; and switch means for electrically disconnecting said first means from said solenoid coil when the flipper is in the actuated position.

18. In a pinball machine having a flipper and including a flipper switch for activating the flipper and means for holding the flipper in an actuated position until the flipper switch is deactivated, a solenoid coil for controlling the movement of the flipper in response to the voltage applied to the solenoid coil, the improvement comprising, in combination:

first means for applying a first voltage to the solenoid coil when the flipper switch is activated, said first means comprising means for supplying a rectified unfiltered voltage;

second means for applying a second, holding voltage to the solenoid coil when the flipper is in the actuated position to hold the flipper in the actuated position until the flipper switch is deactivated, said second means comprising a stepped-down AC voltage source and means for blocking the alternating current from the AC voltage source when the first voltage is being applied to the solenoid coil;

switch means for electrically disconnecting said first means from said solenoid coil when the flipper is in the actuated position, said switch means including a normally closed switch with a capacitor connected in parallel thereto to dissipate energy when said switch is open; and said second means including means for preventing said second means from applying said second voltage to the solenoid coil when said switch means is not electrically disconnecting said first means from said solenoid coil.

* * * * *